US005806599A

United States Patent [19]

Hisaw et al.

[11] Patent Number: 5,806,599

[45] Date of Patent: Sep. 15, 1998

[54] METHOD FOR ACCELERATING PRODUCTION

[76] Inventors: Jack C. Hisaw, 114 Froeba La., Carencro, La. 70520; Michael J. Gazewood, 402 Machine Loop, Scott, La. 70583

[21] Appl. No.: 748,182

[22] Filed: Nov. 12, 1996

Related U.S. Application Data

[63] Continuation-in-part of Ser. No. 637,915, Jul. 12, 1996, Pat. No. 5,562,161.

[51] Int. Cl.[6] ..... E21B 43/00

[52] U.S. Cl. ..... 166/372; 166/68; 166/105

[58] Field of Search ..... 166/369, 370, 166/372, 373, 68, 105

[56] References Cited

U.S. PATENT DOCUMENTS

| | | | |
|---|---|---|---|
| 3,718,407 | 2/1973 | Newbrough | 417/108 |
| 4,390,061 | 6/1983 | Short | 166/53 |
| 4,603,735 | 8/1986 | Black | 166/68 |
| 4,605,069 | 8/1986 | McClaflin et al. | 166/310 |
| 4,726,420 | 2/1988 | Weeks | 166/68 |
| 5,105,889 | 4/1992 | Misikov et al. | 166/372 |
| 5,302,286 | 4/1994 | Semprini et al. | 210/610 |
| 5,374,163 | 12/1994 | Jaikaran | 417/172 |
| 5,407,010 | 4/1995 | Herschberger | 166/372 |
| 5,562,161 | 10/1996 | Hisaw et al. | 166/372 |

*Primary Examiner*—William P. Neuder
*Attorney, Agent, or Firm*—Domingue, Delaune & Waddell

[57] ABSTRACT

A novel venturi device located within a tubular member for accelerating the flow of an effluent is disclosed. The device will generally comprise a tubular member containing a throat section, a diffuser section and an opening contained on the tubular member for allowing the injection of a gas therethrough. The device also includes an inner mandrel contained within the tubular member. The inner mandrel contains a nozzle member defining an internal chamber. The inner mandrel also contains a first passageway and a second passageway for directing the effluent therethrough. The nozzle is operatively associated with the opening contained on the tubular member. In one embodiment, a flow diverter member is included for diverting the production effluent into the first passageway and into the nozzle annulus. A method of accelerating production with a venturi device within a tubing string is also disclosed.

23 Claims, 14 Drawing Sheets

METHOD FOR ACCELERATING PRODUCTION

This application is a continuation-in-part of patent application Ser. No. 08/637,915, now U.S. Pat. No. 5,562,161. The invention relates to a method of increasing production from a well. More particularly, but not by way of limitation, the invention relates to a method of injecting a gas or fluid into a well annulus in order to increase production from a reservoir.

BACKGROUND OF THE INVENTION

Many times, in order to produce oil and gas, a well bore is drilled that will intersect a hydrocarbon bearing reservoir. The initial pressure of the reservoir will be quite substantial. The well will be completed to the reservoir, and thereafter, production may be commenced.

Reservoir fluids and gas will be produced during the life of the well. During the course of production, the reservoir will lose some of the pressure which makes it more difficult to lift the produced fluids and gas to the surface. While the reservoir may contain substantial reserves left to be produced, the inability to withdraw the hydrocarbons due to pressure depletion is a common problem faced by operators.

Numerous devices have been devised in order to overcome the problem of pressure depletion in the reservoir. One common method utilized by operators has been to install within the production tubing a series of gas lift mandrels. As is understood by those of ordinary skill in the art, a gas lift valve is introduced into the mandrel. The gas lift valve will allow gas that is placed into the annulus at a high pressure to be communicated with the inner diameter of the production tubing string.

Generally, gas lift is a method of lifting fluid where relatively high pressure gas is used as the lifting medium through a mechanical process. Two types of method are generally used. First, in continuous flow a continuous volume of high pressure gas is introduced into an eductor tube to aerate or lighten the fluid column until reduction of the bottom hole pressure will allow a sufficient differential across the sand face, causing the well to produce the desired rate of flow.

In order to accomplish this, a flow valve is used that will permit the deepest possible one point injection of available gas lift pressure in conjunction with a valve that will act as a changing or variable orifice to regulate gas injected at the surface depending upon tubing pressure.

The second method is referred to as intermittent flow which involves the expansion of a high pressure gas ascending to a low-pressure outlet. A valve with a large port permits complete volume and pressure expansion control of gas entering into the tubing, thus either regulating lift of the accumulated fluid head above the valve with a maximum velocity to minimize slippage or controlling liquid fall back, fully ejecting it to the tank with minimum gas.

Jet pumps have also been utilized in oil and gas wells in order to produce low pressure wells. For instance, hydraulic jet pumps have been used as a down hole pump for artificial lift applications. An example of this type hydraulic pump is sold by Trico Industries, Inc. under the trade name "Kobe Hydraulic Jet Pumps".

In these types of hydraulic pumps, the pumping action is achieved through energy transfer between two moving streams of fluid. The power fluid at high pressure (low velocity) is converted to a low pressure (high velocity) jet by the nozzle. The pressure at the entrance of the throat becomes lower as the power fluid rate is increased, which is known as the venturi effect. When this pressure becomes lower than the pressure in the suction passageway, fluid is drawn in from the well bore. The suction fluid becomes entrained with the high velocity jet and the pumping action then begins. After mixing in the throat, the combined power fluid and suction fluid is slowed down by the diffuser. Because the velocity is reduced, the pressure increases-rising to a value sufficient to pump the fluid to the surface.

Despite these devices, there is a need for a device to create a zone of low pressure within a tubing and accelerate production from the production reservoir.

SUMMARY OF THE INVENTION

A device located within a tubular member for accelerating an the flow of an effluent is disclosed. The device will generally comprise a tubular member with the internal diameter containing a tapered section (generally including a throat section and a diffuser section) extending from the throat section and an opening contained on the tubular member for allowing the injection of a gas therethrough. The device also includes an inner mandrel contained within the internal diameter of the tubular member. The inner mandrel contains a nozzle member comprising a cylindrical member having a first end and a second end, with the nozzle member defining an internal chamber. The inner mandrel also contains a first passageway disposed within the second end of the nozzle, and a second passageway disposed within the second end. The nozzle is operatively associated with the opening contained on the tubular member.

Generally, the nozzle forms an annulus with the internal diameter of the tubular member. The first end of the nozzle member being adjacent to the throat section so that the injected gas is directed through the opening, to the first channelling means, then into the internal chamber and ultimately out the nozzle into the mixing tube (referred to as the throat section).

In the preferred embodiment, the device will contain a flow diverter means for diverting the production into the first passageway and into the internal chamber. The flow diverter means will include a conical member attached at the second end of the inner mandrel with a base portion and an apex portion, and wherein the base portion is positioned at the second end of the inner mandrel and the apex portion extends therefrom. Also included in the preferred embodiment will be a valve means, operatively associated with the nozzle, for allowing flow in a first direction.

In one embodiment, the tubular member is positioned within a tubing string having an inner diameter and an outer diameter, the tubing string containing a selective means for selectively opening a second opening, with the tubular member being disposed within the sliding sleeve so that the first opening and the second opening are aligned to allow communication of a gas therethrough. The apparatus further comprises a seal means, operatively associated with the second end of the tubular member, for sealingly engaging with the tubing string inner diameter.

In one embodiment, the selective means has associated therewith a profile member. Thus, the device further comprises a lock means, operatively associated with the first end of the tubular member, for locking into the profile member of the selective means. The selective means may be a sliding sleeve member.

In another embodiment, the device may be positioned within a tubing string having a gas lift means for selectively opening an aperture for introduction of a casing annulus gas into the internal diameter of the tubing string. The device is landed into the gas lift means so that the first opening of the tubular member and the aperture of the gas lift means are aligned to allow communication of the casing annulus gas therethrough. In this embodiment, the device further comprises seal means, operatively associated with the second end of the tubular member, for sealingly engaging with the inner diameter of the gas lift mandrel.

The tubular member may have associated therewith wire line means for setting the device within the inner diameter of the tubing string, for instance, into a sliding sleeve or gas lift mandrel.

A method of accelerating production with a venturi device within a tubing string in a well bore is also disclosed. The method includes providing an aperture contained within the tubing string, and lowering into the tubing string the venturi device. In the preferred embodiment, the venturi device comprising (A) an tubular member and (B) a mandrel disposed therein. The tubular member contains a tapered section and an opening for allowing the injection of a gas therethrough. The inner mandrel contains: a first channelling member, a nozzle member directed for discharging the injected gas into the tapered section, and a second channelling member for directing the production about the nozzle.

The method further includes placing the venturi device within the internal diameter of the tubing string (such as a profile locking member contained within the tubing string) and injecting an injection gas into the annulus. Next, the injection gas is directed through the aperture and through the opening contained within the tubular member.

The method further comprises flowing the well so that an effluent is produced. The effluent is directed into the second channel member and the injection gas is directed into the first channel. The discharge of the injection gas from the nozzle to the mixing tube will create a zone of low pressure within the venturi device. The zone of low pressure will thus increase the inflow from the reservoir. The step of creating the zone of low pressure includes flowing the gas through the nozzle, and thereafter, exiting the gas into the throat section so that a zone of high pressure is created within the throat section. A pressure suction is thereafter created in the nozzle annulus due to the venturi effect.

The method further includes the steps of mixing the effluent and the injection gas within the throat section and producing the effluent and injection gas into the diffuser section. In one embodiment, the aperture is provided as part of a sliding sleeve member contained on the tubing string, and wherein the step of providing the aperture includes lowering into the tubing string a shifting device, and shifting the sliding sleeve open so that the aperture allows communication from the well bore annulus into the internal diameter of the tubing string.

A feature of the present invention includes use of a sliding sleeve that has been included as part of a production tubing string. Another feature includes a venturi device that contains a tubular member that has disposed therein an inner mandrel. The inner mandrel will contain a first channelling member for allowing the down hole effluent to be directed therethrough. Another feature is that the inner mandrel has a second channel member that directs the injection gas into an internal chamber of the nozzle.

Still yet another feature includes use of a flow diverter member that channels the down hole effluent into the first channel and into the nozzle annulus. Another feature is that the flow diverter and flow channels are designed to minimize the pressure drop associated with the production effluent flowing through the apparatus. Another feature includes the opening contained on the tubular member may be associated with a sliding sleeve, a gas lift mandrel or an aperture created in a tubing string. Yet another feature includes a profile lock in order to locate the device in the tubing string and thereafter set the device within the inner diameter of the tubing string.

Yet another feature includes seal means for sealing within the inner diameter of the tubing is provided so that the injected gas and production stream is directed through the device for delivery to the surface. Still yet another feature consist of using a variable sized nozzles in order to achieve maximum efficiency of the venturi device. Another feature includes a replaceable throat and diffuser section that may also be replaced in order to achieve maximum efficiency. Another feature is the device may be formed from a composite material.

Still yet another feature is the use of a remedial work string, such as wire line, to set the device within the tubing string. Another feature is the use of a check valve operatively associated with the nozzle to prevent flow of fluid and/or gas within the tubing string to reverse circulate into the casing annulus.

An advantage of the present invention includes that there are no moving parts within the venturi section. Another advantage is that the device is compact and can be placed within the inner diameter of tubing strings. Another advantage is that the invention may be used in highly deviated well bores in order to efficiently lift any fluid which may be resting on the low side of the tubing string.

Another advantage is that the venturi device creates an area of low pressure within the tubing string, and in particular, the venturi device. In other words, the venturi device creates a zone of low pressure within the venturi device so that the zone of low pressure effects the reservoir thereby enhancing production. Still yet another advantage is that the reservoir fluids will be entrained with the injected gas thereby lifting the fluids to the surface. Another advantage is that the design directs the injected gas away from the reservoir and towards the surface so that the injected gas does not expand downward.

Yet another advantage includes that in the throat, the injected gas and produced fluid mix, and momentum is transferred from the injected gas to the produced fluid, causing an energy rise in the produced fluid. Once the produced fluid and injected gas travel through the throat, the mixed fluid enters an expanding area diffuser that converts the remaining kinetic energy to static pressure by slowing down the fluid velocity. The pressure in the fluid is now sufficient to flow the reservoir fluids and gas to the surface.

In one embodiment herein disclosed, the device may be installed in wells with gas lift mandrels and/or sliding sleeves already within the tubing string. Still yet another advantage is that in wells without gas lift mandrels or sliding sleeves, a perforation may be formed through the tubing and the invention may be utilized. Another advantage is that the embodiments herein described may be removed from the inner diameter of the tubing strings without obstructing the inner diameter. Still yet another advantage is that the nozzle and throat sections may be replaced with more efficient sizes. Yet another advantage is that the device may be used as an intermittent lift system in order to unload wells such as unloading water from gas wells. Another advantage is that the device may be used in pipelines and other types of flow lines that transport fluids.

BRIEF DESCRIPTION OF THE PREFERRED EMBODIMENTS

DETAILED DESCRIPTION OF THE PREFERRED EMBODIMENT

Figure 1:
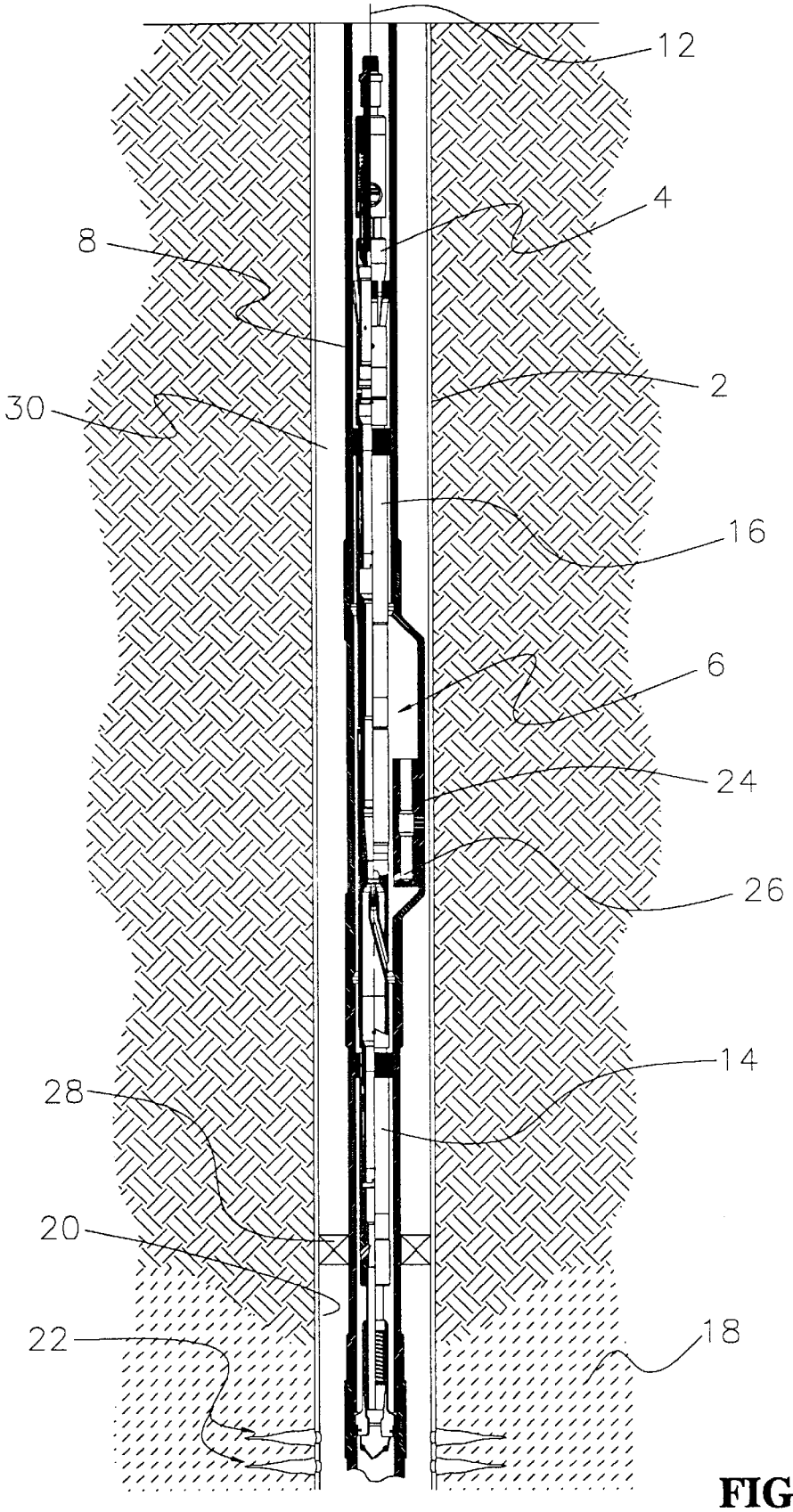
FIG. 1 is a schematic of a typical well bore with the third section of one embodiment of the invention being positioned within the tubing string by means of a wire line unit.

Referring now to FIG. 1, a typical well bore 2 with the third section 4 of the invention 6 being positioned within the tubing string 8 by means of a wire line unit (not shown) having a wire line 12 extending therefrom is shown. As seen in FIG. 1, the first section 14 and the second section 16 of the invention would have already placed within the tubing string 8, and the third section is being positioned within the tubing string 8, as will be more fully explained hereinafter.

The well bore 2 is generally a casing string that intersects various subterranean reservoirs. Some of the reservoirs will contain commercial deposits of hydrocarbons. The well bore 2 will be completed to the reservoir 18 with the reservoir's fluid and gas being produced into the lower annulus 20 through the perforations 22. The produced reservoir fluid and gas may be referred to as effluent.

FIG. 1 also depicts a tubing string 8 that has disposed thereon a gas lift mandrel 24 that has a side pocket for the placement of a gas lift valve. In the embodiment shown in FIG. 1, the gas lift valve has been removed and in its place has been placed a ported valve 26. The ported valve 26 was placed within the side pocket using traditional wire line methods, as is understood by those of ordinary skill in the art.

A packer means 28, operatively associated with the tubing string 8, for sealingly engaging the tubing string 8 with the casing 2 so that an upper annulus 30 and the lower annulus 20 is formed. It should be noted that like numbers in the various figures of the application refer to like components.

Figure 2A:
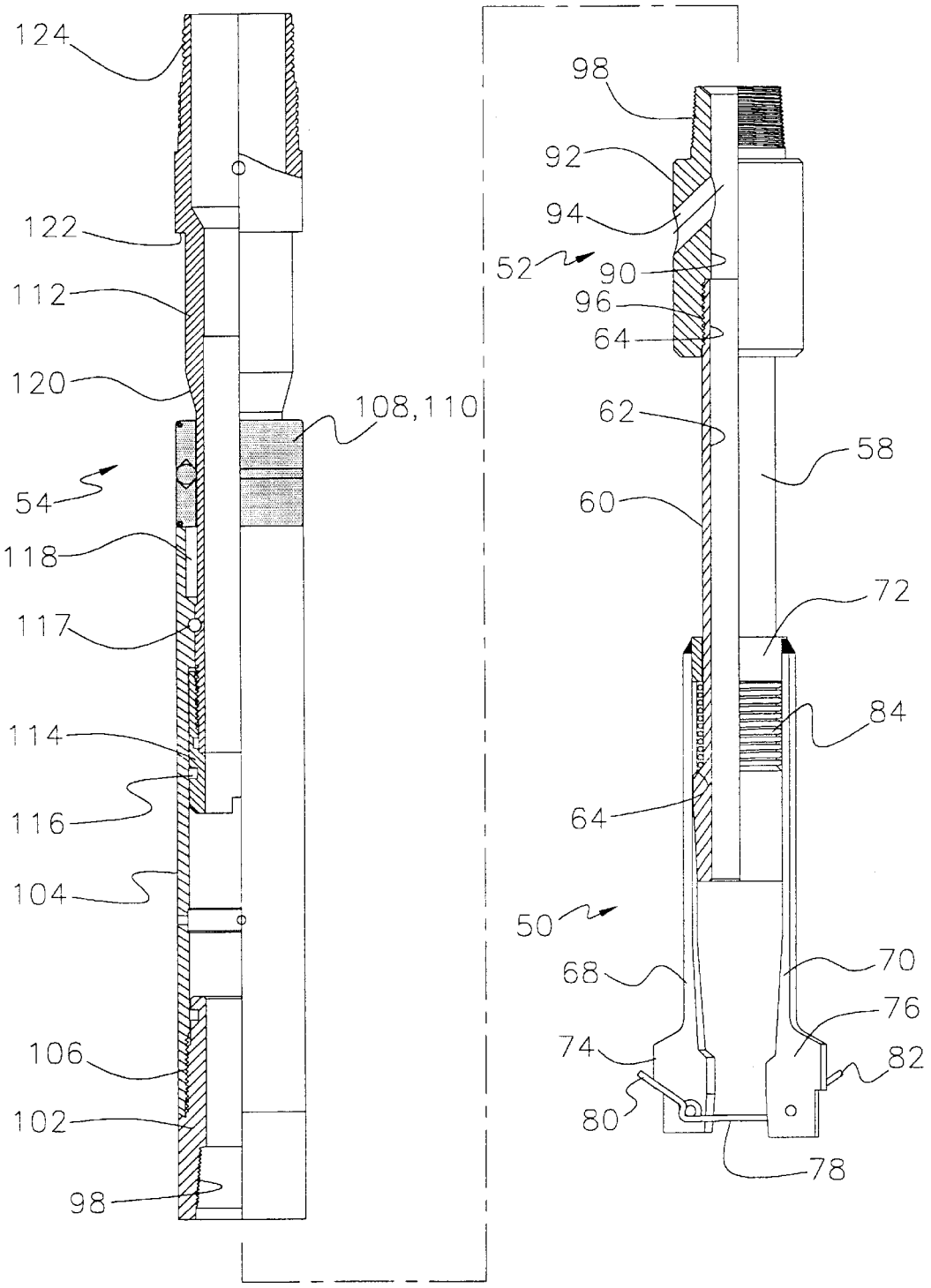
FIGS. 2A–2B are an enlarged partial sectional view of the first section of an embodiment of the invention that is positioned within the tubing string.
Figure 2B:
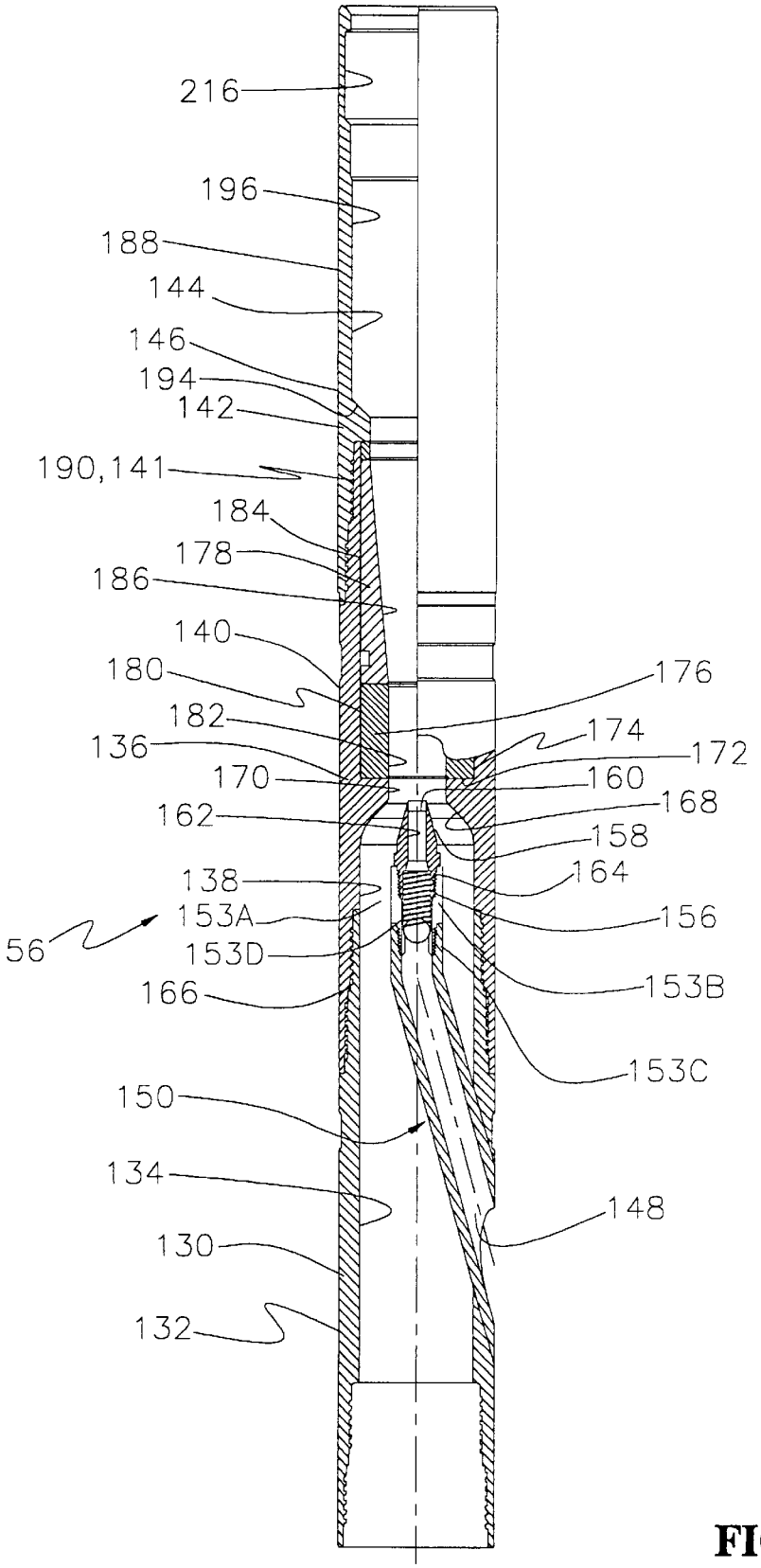

Referring now to FIGS. 2A–2B, an enlarged partial sectional view of the first section of the invention that is positioned within the tubing string is illustrated. Generally, the first section comprises the components of a spring loaded collar stop means 50 for locating in a collar, a lower flow sub 52 means for allowing the flow of the reservoir's 18 fluids and gas, a lower sealing means 54 for sealingly engaging the inner diameter of the tubing string 8, and the venturi means 56 for increasing the velocity of the reservoir fluids and creating a zone of low pressure within the inner diameter of the tubing string 8.

The spring loaded collar stop means 50 includes a mandrel 58 having an outer surface 60 and an inner surface 62. The outer surface 60 of the mandrel 58 will have on one end the external thread means 64, while on the opposite end the surface 60 has a shoulder 64. The spring loaded collar stop means 50 also includes a first arm 68 and second arm 70 that has one end attached to a ring member 72, with the ring member being disposed about the mandrel 58. The second end of the arms 68, 70 contains a protuberances 74, 76 respectively, for engagement into a collar recess, that will be explained in greater detail later in the application. The protuberances 74, 76 are axially held together by the springs 78, with the spring having a first prong 80 and a second prong 82 for catching the collar recess. Due to the shape of the arms 68, 70, when held together by the spring 78 (as shown in FIG. 2), the arms 68, 70 can not travel axially upward on the mandrel 58. Disposed about the outer surface 60 is the spring means 84 for biasing the ring member 72 axially upward. The spring means 84 will be in compression as long as the spring 80 is not tripped.

The collar stop 50 is attached to the flow sub means 52. The flow sub means 52 generally comprises an inner diameter surface 90 and an outer diameter surface 92. The flow sub 52 will contain a flow port 94 which communicates the flow from the reservoir 18 with the inner diameter of the flow sub means 52. The flow sub means 52 will have internal thread means 96 that engage with the thread means 64, as well as the external thread means 98.

The lower sealing means 54 is connected to the flow sub 52. Normally, the lower sealing means 54 will comprise a first adapter 102 that is connected to a housing member 104. The housing member 104 will have a first end 106 that is connected to the adapter 102. The second end 108 will have disposed thereon a seal means 110 for sealingly engaging the inner diameter of the tubing string 8.

An inner setting mandrel 112 is disposed within the housing member 104. As depicted in FIG. 2A, the inner mandrel 112 has attached thereto a sub member 114 that has contained thereon the seal means 116 for sealingly engaging the inner diameter of the housing member 104. The upper seal means 110 will have a shear pin member 117 that selectively attaches the housing 104 and inner mandrel 112 together. The outer diameter 118 of the inner mandrel 112 has a chamfered surface 120 that ultimately extends to the shoulder 122. The inner mandrel 112 will then be attached to the venturi means 56 via the external thread means 124.

The venturi means 56 includes a first housing 130 that has an outer diameter 132 and an inner diameter 134. The venturi means 56 will have a second housing 136 that is attached to the first housing 130, with the second housing having an inner diameter 138 and an outer diameter 140, with the outer diameter extending to the external threads 141. The venturi means 56 also has a third housing 142 attached to the second housing, with the third housing 142 having an inner diameter 144 and an outer diameter 146.

The first housing 130 will contain a flow port 148, with a flow tube diverter means 150 for diverting the flow of an injected gas from the annulus area 30 into the inner diameter of the invention, as will be explained later in the application. Basically, the flow tube diverter means 150 includes a cylindrical member 152 that extends from the flow port 148. The flow tube diverter means 150 extends into the inner diameter of the invention in a direction that directs the flow of high pressure natural gas upward relative to the perforations 22. In other words, the tube diverter means 150 directs the flow of natural gas toward the surface relative to the perforations 22. Attached to the flow tube diverter means 150 is the check valve means 153A, operatively associated with the nozzle means 154, for preventing flow of fluid and/or gas within the tubing string to reverse circulate into the casing annulus. The check valve means 153A herein illustrated contains a check valve assembly housing 153B, a ball 153C, and spring 153D for biasing the ball 153C. Thus, if flow enters down the casing annulus and into the tube diverter means 150, the ball 153C will unseat thereby allowing flow as will be more fully described.

Attached at one end of the flow tube diverter means 150 (and in the preferred embodiment to the check valve means 153) will be the replaceable nozzle means 154. Generally, the nozzle means is threadedly attached to the tube diverter means 150 by external threads 156. The external thread means 156 extend to a chamfered outer surface 158 that concludes at the nozzle opening diameter 160. Extending radially inward of the opening 160 is the inner diameter surface 162 that in turn extends to an expanded inner diameter surface 164.

The second housing 136 will contain at one end internal thread means 166 that will threadedly engage the first housing. The inner diameter surface 138 narrows, as seen at 168, and concludes at the inner bore surface 170. Thus, the surfaces 138, 168 and 170 form the entry to the throat section of the venturi means. The inner bore surface 170 concludes at the radial shoulder 172 which in turn extends to the inner surface 174.

The second housing 136 has contained therein the replaceable throat section 176 which abuts the replaceable diffuser section 178. Generally, the throat section 176 will have an outer cylindrical surface 180 that is disposed within the inner surface 174, and the throat section 176 will have an inner diameter bore 182. The ratio of the inner diameter bore 182 relative to the nozzle opening diameter 160 is an important factor in designing the amount of velocity and pressure amounts required, as will be described later in the application.

The diffuser section 178 will have an outer cylindrical surface 184 with a groove for placement of a seal means, with the outer cylindrical surface 184 being disposed within the inner surface 174. Extending radially inward is the expanding inner bore surface 186. The ratio of the expanding inner bore surface 186 to the nozzle opening and throat inner diameter is also an important factor in designing the amount of velocity and pressure amounts require, as will be described later in the application. As can be seen in FIG. 2, the diameter is expanding in the normal direction of flow.

The third housing 142 will have an outer surface 188 that extends to one end that has thread means 190 (which engage with the thread means 141) while on the other end is the fishing neck profile 192. Extending radially inward, the third housing will have a chamfered shoulder 194 which in turn extends to the internal bore surface 196, which in the preferred embodiment is a polished bore receptacle.

Figure 3:
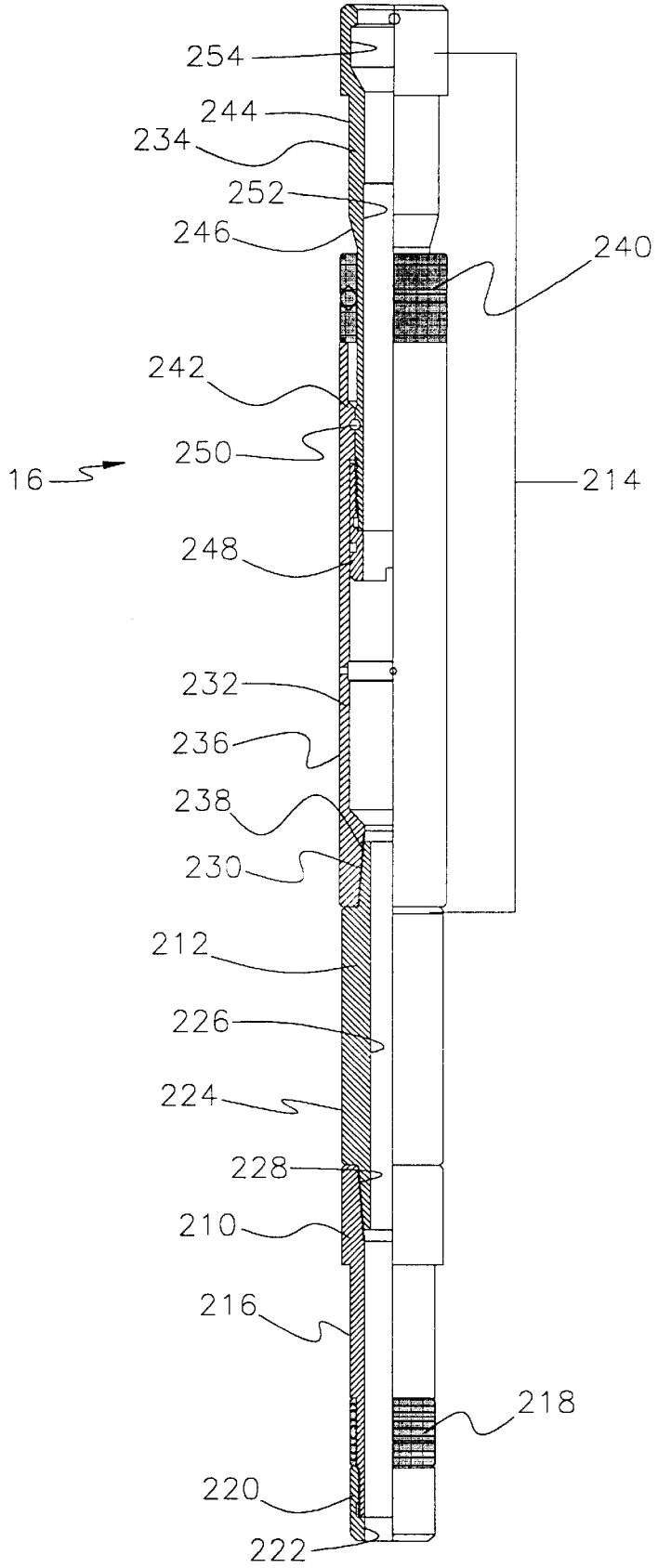
FIG. 3 is an enlarged partial sectional view of the second section of an embodiment of the invention that is positioned within the tubing string.

Referring now to FIG. 3, the second section 16 which is run into the well bore 2 will now be described. Generally, the second section comprises a stinger assembly 210, a spacer pipe 212, and an upper seal means (also known as a pack off) 214 which is similar in design to the lower seal means 54. The stinger assembly 210 has an outer cylindrical surface 216 that has contained thereon a set of seal means 218, with the seal means ending at the bottom sub 220. The seal means 218 will cooperate with the polished bore receptacle 196 so that a seal is established once the second section 16 is run into and stung into the first section 14. Extending radially inward is the internal surface 222.

The spacer pipe 212 has an outer surface 224 and an inner surface 226, with the spacer pipe 212 being attached at one end via thread means 228 to the stinger assembly 210, and with thread means 230 to the upper pack off 214.

The upper seal means (also known as the pack off) 214 generally includes a housing member 232 and an inner setting mandrel 234 that cooperates therewith. The housing member 232 will contain an outer surface 236 that has at one end thread means 238 for threadedly attaching to the spacer pipe 212 and at the other end seal means 240 for sealingly engaging the inner diameter of the production string 8. The inner diameter of housing member 232 will have a shoulder 242.

The inner mandrel 234, which is similar in design to the inner mandrel 112 of the lower seal means 54, is disposed within the housing 232. The inner mandrel 234 will contain an outer cylindrical surface 244 that concludes to a chamfered surface 246 which in turn extends to the sub member 248. The upper seal means 214 will have a shear pin member 250 that selectively attaches the housing 232 and inner mandrel 234 together. The internal diameter 252 of the inner mandrel 234 extends to the fishing neck profile 254.

Figure 4:
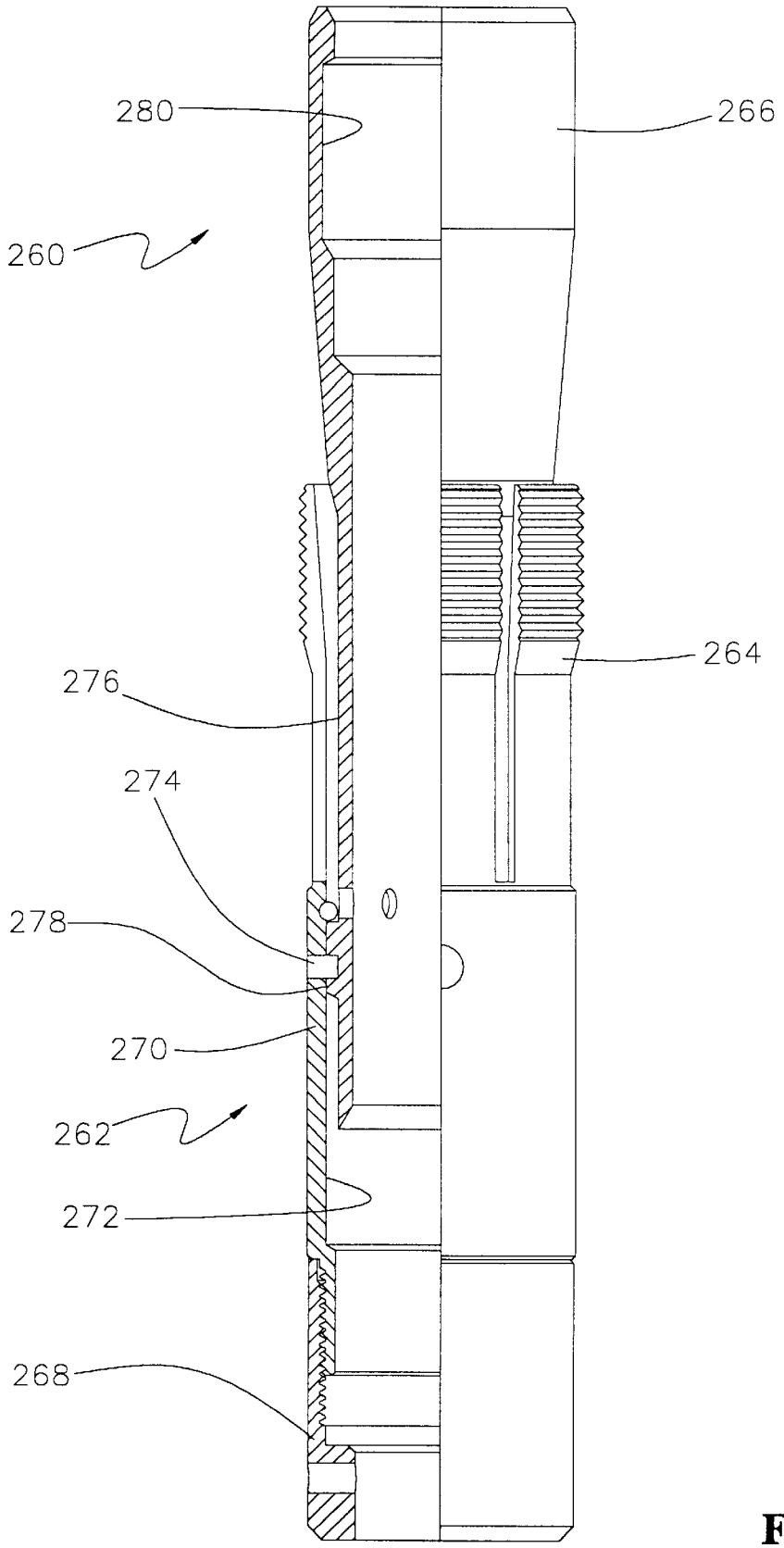
FIG. 4 is an enlarged partial sectional view of the third section of an embodiment of the invention that is positioned within the tubing string.

Referring now to FIG. 4, an anchor apparatus 260 known to those of ordinary skill in the art as a "G-Stop" will now be described. The G-Stop contains a housing 262, a slip means 264 operatively associated therewith, and a setting mandrel 266. The housing may have a first cylindrical section 268 and a second cylindrical section 270, with the first and second section being threadedly connected. The inner bore 272 of the second section will disposed within the setting mandrel 266, with the setting mandrel 266 being attached to the second section by means of a shear pin 274.

The setting mandrel 266 comprises an outer surface 276 that has disposed thereon a shoulder 278, with the surface 276 generally increasing in outer diameter. Extending radially inward is the fishing neck 280. The slip means 264 are operatively connected to the housing 262 and are operatively associated with the setting mandrel 266 for engagement with the inner diameter of the tubing string 8.

Figure 5:
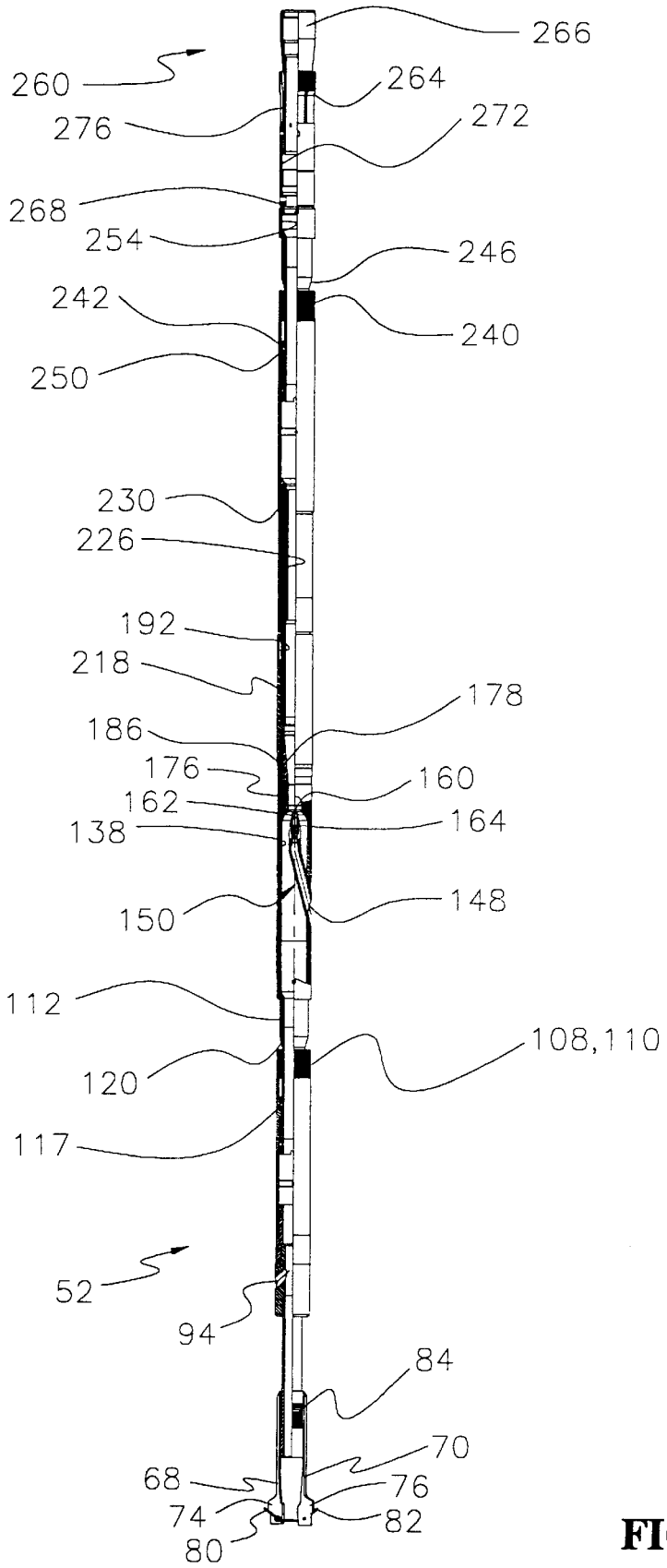
FIG. 5 is an enlarged partial sectional view of the first, second, and third sections of FIGS. 2–4 assembled in tandem.

The first section 14, second section 16, and third section 260 are individually run into the tubing string 8 by means of a "GS" Pulling Tool (not shown) that is well understood by those of ordinary skill in the art. A "GS" Pulling Tool is commercially available from Specialty Machine & Supply, Inc. The sequence of running into the tubing string 8, as well as pulling out of the tubing string 8, will be described herein after. With reference to FIG. 5, the assembled invention is shown before any of the various components have been set within the inner diameter of the tubing string 8.

Figure 6:
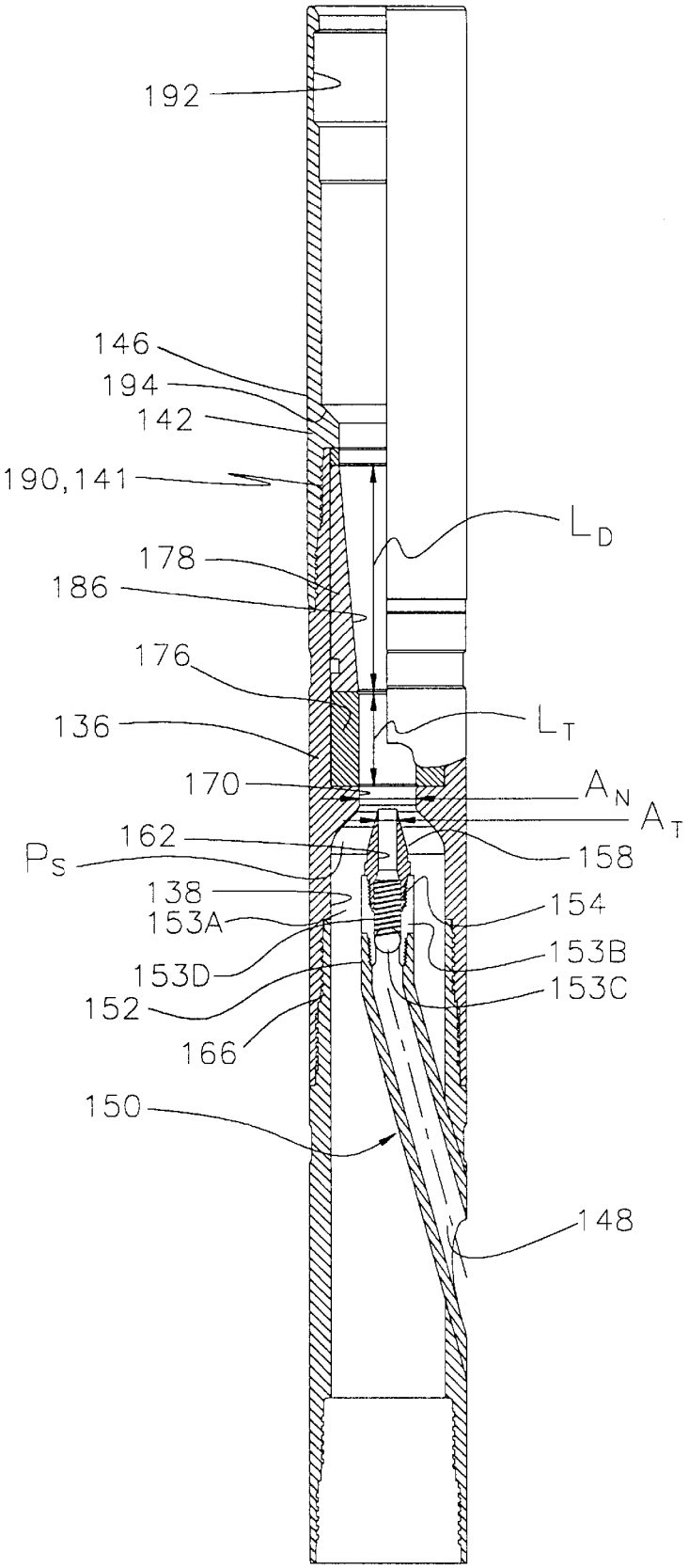
FIG. 6 is an enlarged sectional view of the venturi means of the FIGS. 2–4.

Referring now to FIG. 6, an enlarged view of the venturi means 56 will be discussed. The nozzle opening 160 will have an area An. The inner bore 182 throat will have an area At which is greater than the area An. Further, the length Lt of the throat section 176, as well as the length Ld will have effects as to the pressure and velocity profiles of the injected gas and the produced reservoir fluids. FIG. 7 has also been included which depicts a partial sectional view of the first embodiment of the invention that is positioned within a sliding sleeve member contained within a tubing string.

In order to utilize the invention 6 herein described in FIGS. 1–7, the operator will position the first section 14 into the tubing string 8. In the embodiment herein described, the tubing string has a gas lift mandrel 24 even though the invention 6 is applicable to tubing strings that do not contain gas lift mandrels. The sections may be lowered via a wire line 12. Other remedial work strings, such as coiled tubing, are available to set these devices.

The bottom hole assembly will generally comprise the spring loaded collar stop means 50, lower flow sub means 52, pack-off member and venturi means 56 as shown in FIG. 2. The bottom hole assembly will be connected to a "GS" Running Tool which is commercially available from Specialty Machine & Supply, Inc. The procedure for setting includes lowering the wire line 12 and allowing the prongs 80, 82 of the spring 78 to be lowered through the collars contained on the tubing strings. Once the operators is at the proper depth, the bottom hole assembly is lifted so that the prongs 80, 82 catch in the collar. Once the prongs 80, 82 catch in the collar, the springs 78 will be undone thereby allowing the arms 68 and 70 to expand as well as releasing the spring 84. The arms 68, 70 (and in particular the protuberances 74, 78) will be held within the collar and allow an anchor for setting the lower seal means 54 (as seen in FIG. 1).

Next, the setting of the lower seal means is achieved by jarring down on the bottom hole assembly in a conventional manner. The jarring down will allow the chamfered surface 120 of the inner mandrel 112 to shear the pin 117 so that the mandrel 112 moves down; the housing member 104, however, has been held stationary, and thus, the chamfered surface 120 expands the seal means 110 as is understood by those of ordinary skill in the art.

The operator will then pull out of the tubing string 8 with the "GS" Running Tool. The second section 16 (as seen in FIG. 3) is then assembled, which comprises the stinger assembly 210, spacer pipe 212, and the upper pack off 214. The second section 16 is positioned within the tubing string via the wire line 12 and is run into the tubing 8 with the "GS" Running Tool. The stinger assembly 210, and in particular the seal means 218, will locate into the polished bore receptacle 196 and will abut chamfered shoulder 194.

The second section 16 is set in a similar manner as the first section 14 in that the bottom hole assembly is jarred down which in turn will cause the inner setting mandrel 234 to move down relative to the stationary housing member 232. The shear pin 250 is sheared after the appropriate force has been applied via jarring. The chamfered surface 246 will cause the seal means 240 to expand into sealingly engagement with the inner tubing sting 8.

The operator will then pull out of the tubing string 8 with the "GS" Running Tool. The third section 260 (as seen in FIG. 4 and referred to as the "G-Stop") is then lowered via the wire line 12. The G-Stop 260 is set by jarring down on the top portion of the setting mandrel 266 so that the shear pin 274 is sheared. The setting mandrel 266 moves down relative to the stationary housing 262 so that the slip means 264 expand (due to the chamfered surface of the setting mandrel 266) into the inner diameter of the tubing string 8. The assembled invention as set across the gas lift mandrel is seen in FIG. 1.

In order to increase production from the reservoir 18, the operator will accelerate velocity of the reservoir's 18 hydrocarbons within the invention as well as creating a zone of low pressure within the invention. This is done by injecting a high pressure gas from the surface into the upper annulus 30. The gas will exit at the nozzle 154 once the check-valve 153A shifts to the open position, and in particular, the nozzle opening 160.

The pressure/velocity transfer is achieved through energy transfer between the high pressure injection gas and the production reservoir fluids. The power gas at high pressure (low velocity) is converted to a low pressure (high velocity) jet by the nozzle 154, as seen in FIG. 6. The pressure at the entrance of the throat 176 becomes lower as the power gas rate is increased, which is known as the venturi effect. When this pressure becomes lower than the pressure in the suction passageway (Ps), fluid is drawn in from the area below the flow tube diverter 150. The device creates a zone of low pressure on the production formation. The suction fluid (reservoir 18 fluid) becomes entrained with the high velocity jet and the pumping action then begins. After mixing in the throat 176, the combined power gas and suction fluid is slowed down within the diffuser 178. Because the velocity of this mixed stream (power gas and suction fluid) is reduced, the pressure increases within the diffuser 178-rising to a value sufficient to pump the fluid to the surface.

In one embodiment, the injection of the power gas is initiated for a predetermined amount of time. After expiration of a predetermined amount of time, the power gas injection is then terminated, again for a predetermined time period in order to unload the well. This sequence may be repeated as many times as desired by the operator. Further, the amount of time of injection as well as shut-in may be varied in order to obtain maximum production efficiency.

During the life of the reservoir 18, the operator may deem it appropriate to change the nozzle 154, check-valve 153A, throat 176, and/or the diffuser section 178 in order to optimize production. The method would then comprise the steps of retrieving the "G-Stop" by running in the tubing second with a "GS Pulling Tool", and engaging in the fishing neck, as is well understood by those of ordinary skill in the art, and pulling out of the tubing 8 with the G-Stop. Next, the GS Pulling Tool is again run into the tubing 8 and the second section 16 is pulled by engaging into the fishing neck 254. The second section is then retrieved from the tubing 8. The third section is then pulled out of the tubing 8 in a similar manner using a "GS" Pulling Tool.

At the surface, the operator may then replace the nozzle 154 with a second nozzle of different size. The purposes of replacing the nozzle may be to substitute for a different size, or alternatively, to replace a damaged nozzle. Other components of the first section 14 may also be replaced.

Generally, the area of the nozzle (An) for a venturi device in relation to the area of the throat (At) is an important design consideration (as seen in FIGS. 6/9). Further, the length of the throat (Lt) in relation to the length of the diffuser (Ld) is another important design consideration as well as the length of the throat in relation to the inside diameter of the throat. Thus, the operator may change out individual components or may wish to substitute another second section.

After replacing the necessary components, the operator may then lower into the tubing 8 on wire line 12 and replace the first section 14. The other components of the first section remain the same, namely the spring loaded collar stop means 50, the lower flow sub means 52, the lower sealing means 54, and venturi means 56. The first section is lowered and set as described earlier.

The second section 16, which includes a stinger assembly 210, a spacer pipe 212, and an upper seal means (also known as a pack off) 214 which is similar in design to the lower seal means 54. The second section will be lowered and set as described earlier. Finally, the G-Stop 260 will be lowered and set as described earlier.

Figures 7A, 7B:
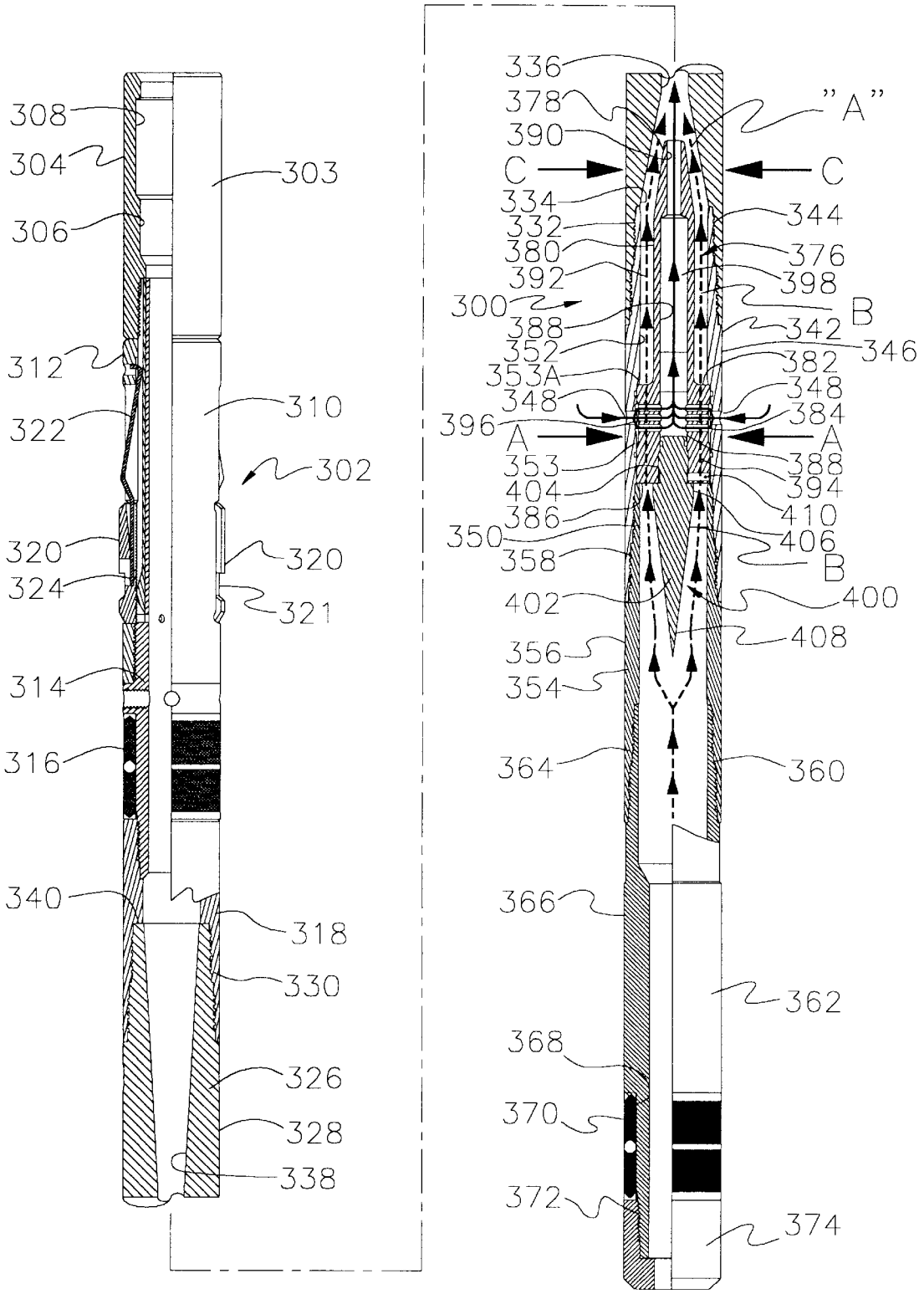
FIGS. 7A–7B are an enlarged partial sectional view of preferred embodiment of the invention including a lock profile member.

Referring now to FIGS. 7A and 7B, an enlarged partial sectional view of the preferred embodiment of the present invention will now be discussed. The production accelerator device, seen generally at 300, will have associated therewith a locking means 302 for locking into a nipple profile that is included within the tubing string, and in particular, associated with the sliding sleeve member which will be described in FIGS. 8A and 8B. The locking means 302 is commercially available from Specialty Machine & Supply Inc. under the mark SMSX Lock.

The locking means 302 will contain a first cylindrical member 303 having an outer cylindrical surface 304 that extends to a inner surface 306 that includes a fishing neck 308. The first cylindrical member 303 is attached with a second cylindrical member 310 that has an outer cylindrical surface 312 with the outer cylindrical surface 312 having openings therein. A third cylindrical member 314 is included that has disposed thereon a series of o-rings 316, with the o-rings 316 sealingly engaging an inner bore within the profile member. A fourth cylindrical member 318 extends from the third cylindrical member 314.

Figure 9A:
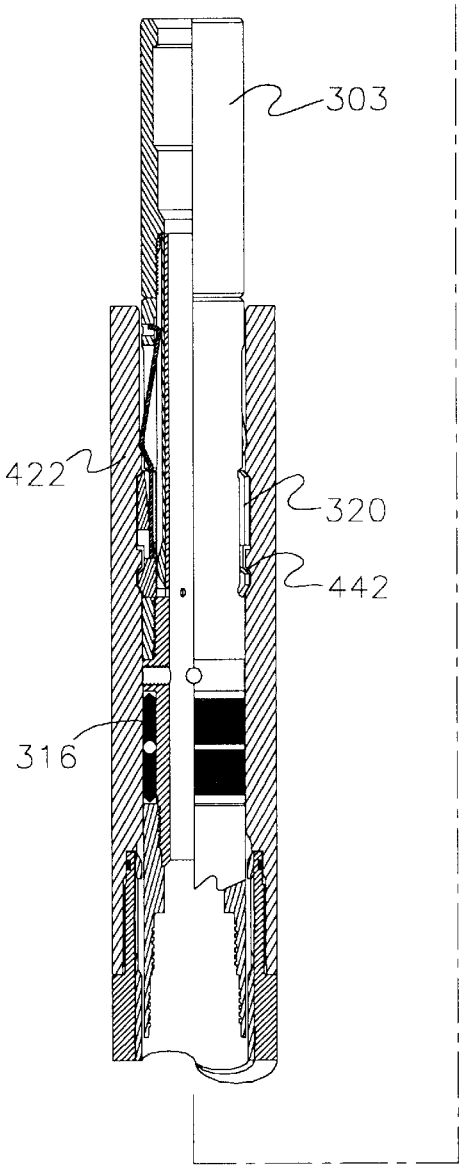
FIGS. 9A–9B are the embodiment of FIGS. 7A–7B shown in the sliding sleeve member of FIGS. 8A–8B.

The locking means 302 has associated therewith a plurality of locking keys 320 with the recess 321 that are urged into engagement with a cooperating profile located on the nipple profile member as is better depicted in FIG. 9A. The locking keys are urged into engagement with the profile via the spring 322 and prong member 324.

Figures 8A, 8B:
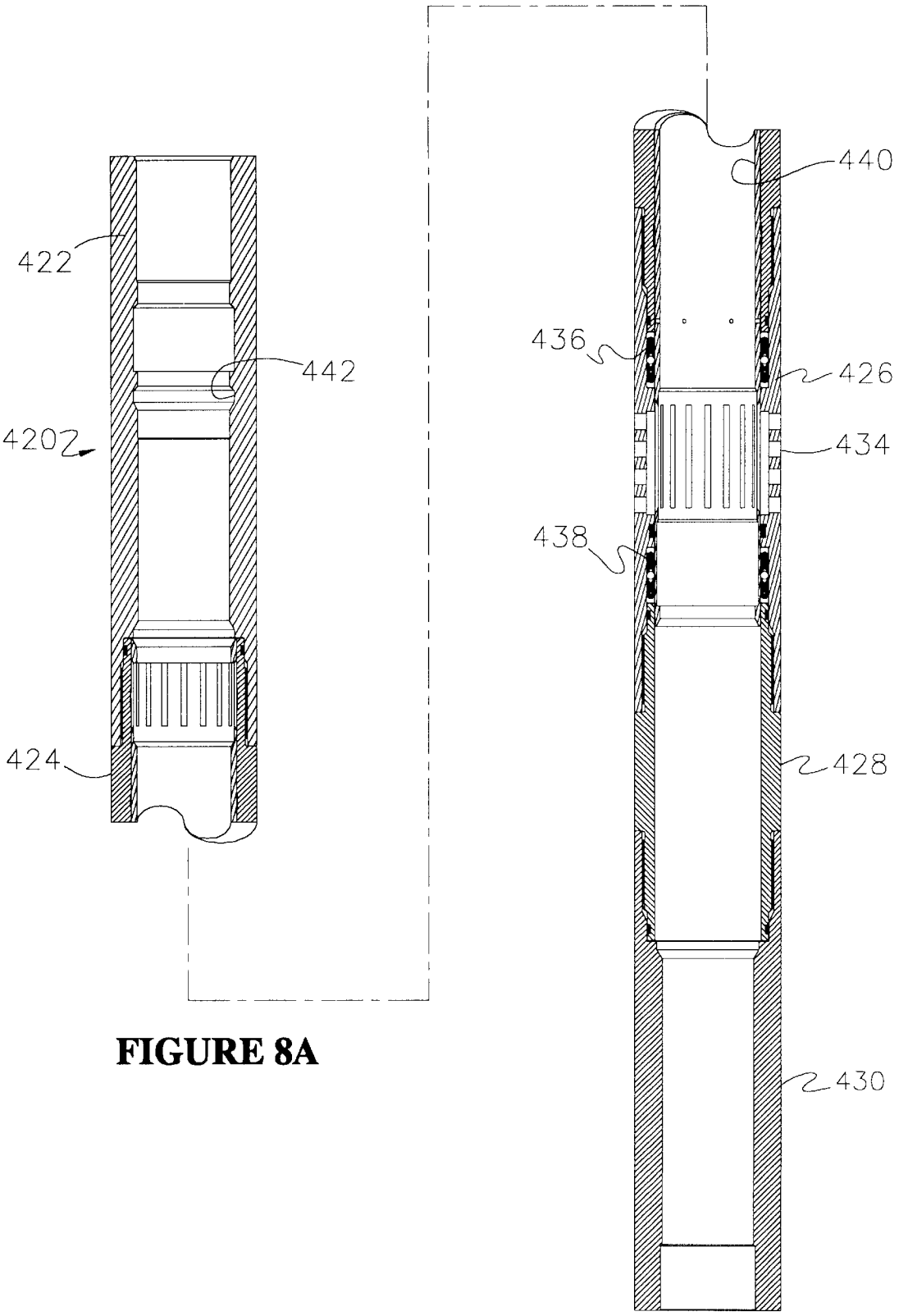
FIGS. 8A–8B are an enlarged partial sectional view of a sliding sleeve member which may be utilized with the embodiment of FIGS. 7A–7B.

The production accelerating device 300 will contain a tubular member that includes a first cylindrical component 326, a first outer cylindrical surface 328 that has at one end external thread means 330 that are engaged with the internal thread means contained on the locking means 302. The outer cylindrical surface 328 will extend radially inward to the internal thread means 332, with the internal thread means 332 extending to the inner diameter surface 334. The inner diameter surface will begin to taper from the surface 334 as seen in FIG. 8B so that a tapered section is formed. The tapered inner diameter surface will reach a point of constant diameter at point 336. Thereafter, the inner diameter surface will begin to increase generally beginning at point 338 until the inner diameter surface terminates at the radial shoulder 340. As better viewed in FIG. 10, the area of the nozzle (An), the area of the throat (At), the length of throat (Lt) and the length of the diffuser (Ld) are factors that may be varied in order to increase performance of the venturi effect, as pointed out earlier.

The second cylindrical component 342 will include the external threads 344 that extend to the outer cylindrical surface 346 with the outer cylindrical surface 346 containing an opening 348 for allowing the injection of a gas therethrough. Extending radially inward of the outer cylindrical surface 346 is the internal thread means 350 and the first inner bore 352 that extends to a second inner bore 353 such that a shoulder 353A is formed. The third cylindrical component 354 will have an outer cylindrical surface 356 that has external thread means 358 at first end and internal thread means 360 at the second end.

The fourth cylindrical component 362 contains external threads 364 that cooperate with the internal thread means 360, with the threads 364 extending to the outer cylindrical surface 366. The cylindrical surface 366 containing a recess 368 that contains a series of o-rings 370 for sealingly engaging the with a cooperating inner bore, for example, the inner bore of the sliding sleeve of FIGS. 9A–9B. The fourth cylindrical component 362 contains the external thread means 372. The fourth cylindrical component 362 may also in the preferred embodiment an end cap 374 for cooperation with the thread means 372.

The production accelerator device 300 will also include an inner mandrel, seen generally at 376, contained within the internal diameter of the tubular member. The inner mandrel 376 includes a first end having a nozzle, the nozzle having a first outer conical surface (tip) 378 that extends to the outer cylindrical surface 380. The outer cylindrical surface 380 terminates at the generally radial surface 382 that in turn extends to the outer cylindrical surface 384, with the radial surface 382 cooperating with the shoulder 353A such that the shoulder 353A and surface 382 abut each other. The outer cylindrical surface 384 extends to the generally radial surface 386 which in turn extends to the first inner bore surface 388, and thereafter, to the second inner bore surface 390. It should be noted that a nozzle annulus 392 is formed between the surfaces 378, 380 and the bore 352.

The inner mandrel 376 will have disposed therein a first passageway 394 that will allow the passage of the produced effluent from the reservoir into the annulus area 392. Further, the inner mandrel 376 has disposed therein a second passageway 396 that is operatively associated with the opening 348 such that the injection gas within the well bore annulus is allowed passage into the internal chamber 398 of the nozzle. The first passageway 394 runs generally longitudinally with the axis of the inner diameter of the tubing string while the second passageway 396 runs generally transverse with the axis of the inner diameter of the tubing string.

In the preferred embodiment, the production accelerator device 300 will also include a flow diverter means 400 for diverting the production into the first passageway 394 and into the annulus 392. As depicted in FIG. 7B, the flow diverter means 400 contains a conical member 402 that has an outer cylindrical base 404 that is operatively associated with the inner bore 388. The base 404 leads to the conical surface 406 that ultimately narrows to the apex portion 408. The conical member 402 may be held in place relative to the inner mandrel 376 via a set screw 410. The flow diverter means 400 and flow channels 394, 396 are designed to minimize the pressure drop associated with the production effluent flowing through the apparatus.

Referring now to FIGS. 8A & 8B, an enlarged partial sectional view of a sliding sleeve member 420 which may be utilized with the production accelerator device 300. The sliding sleeve member 420 is commercially available from Halliburton Energy Services under the mark Sliding Sleeve. Generally, the sliding sleeve 420 will contain a first cylindrical member 422, a second cylindrical member 424, a third cylindrical member 426, a fourth cylindrical member 428, and a fifth cylindrical member 430. The fourth cylindrical member 426 contains a series of openings 434.

A set of inner seal members 436, 438 is provided that cooperate with an inner mandrel 440 slidably disposed within the inner bore of the sliding sleeve 420. The inner mandrel 440 may be placed in the up position as seen in FIG.

9B so that the opening is exposed wherein the sliding sleeve member 420 is in the open position. The inner mandrel 440 is shifted from the closed position to the open position via wire line means as will be appreciated by those of ordinary skill in the art; and, the inner mandrel 440 may be shifted back to the closed position from the open position via the wire line means. Also, the first cylindrical member 422 has contained within the inner bore a nipple profile 442 for cooperation with the locking means 302, and in particular, the locking keys 320.

Figure 9B:
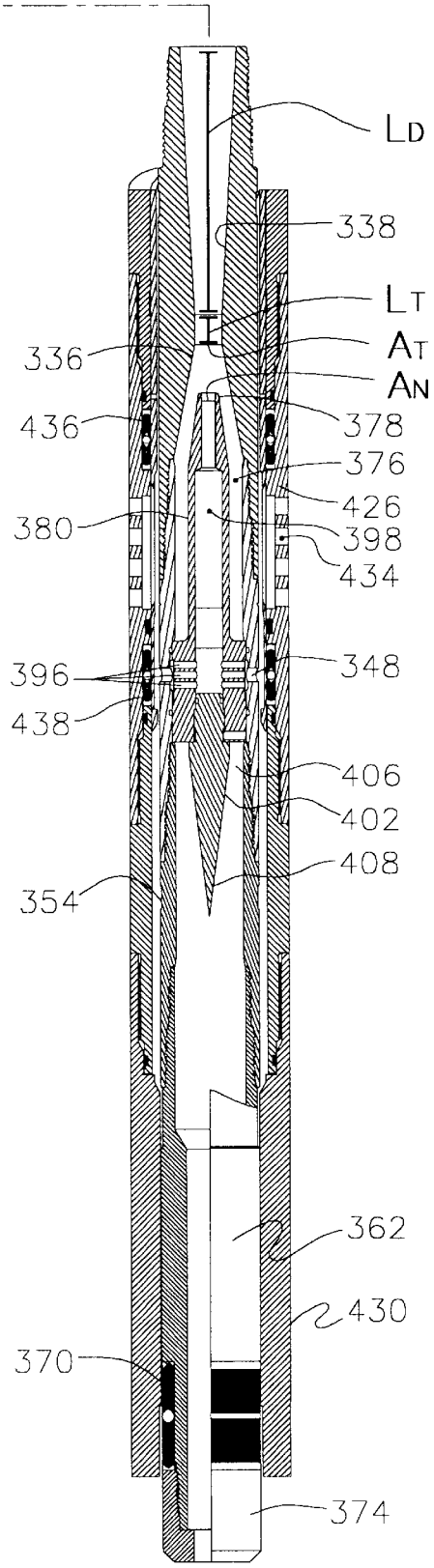

Referring now to FIGS. 9A–9B, an embodiment of the production accelerator 300 shown in the sliding sleeve member 420 of FIG. 8A and 8B is depicted. It should be noted that like numbers in the various figures refer to like components. Thus, the production accelerator 300 that has associated therewith the locking keys 320 is seated within the nipple profile 442. The seal means 316 will engage the inner bore of the first cylindrical member 422, and the seal means 370 will engage the inner bore of the fifth cylindrical member 430. As depicted in FIG. 9B, the injection gas in the well bore annulus will enter the openings 434 of the sliding sleeve member 420, enter the opening 348 and into the passageway 396. The injection gas is directed to the internal chamber 398 and exits the nozzle tip 378.

Figure 10:
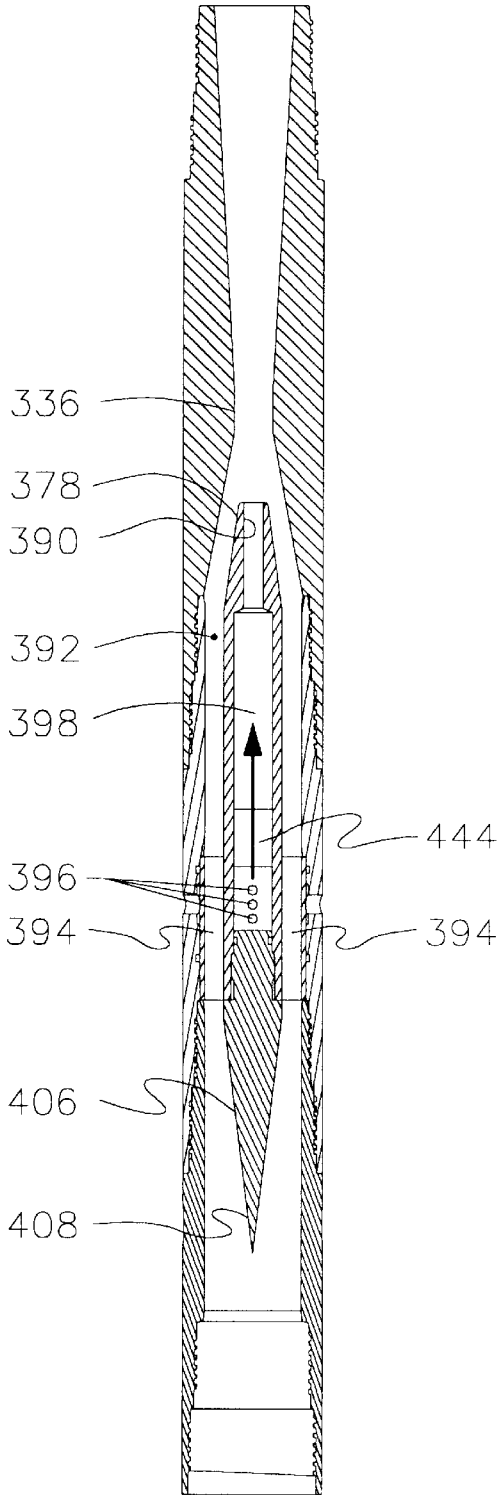
FIG. 10 is the embodiment of FIGS. 7A–7B shown rotated at an angle of 90 degrees.

In FIG. 10, the embodiment of the production accelerator of FIGS. 7A–7B is shown rotated at an angle of 90 degrees. Thus, the first passageway 394 provides a passage for the effluent produced from the hydrocarbon bearing reservoir into the annulus 392 and ultimately into the throat section as will be more fully explained hereinafter.

The FIG. 10 also shows the second passageway 396, with the second passageway 396 allowing the passage of the injection gas into the internal chamber 398. FIG. 10 also depicts an embodiment that contains a one-way check valve means 444 for allowing the flow of the injection gas from the second passageway 396 through the internal chamber 398 and into the inner bore 390 of the nozzle, but not allow a back-flow of fluid and/or gas through the nozzle, internal chamber 398, second passageway 396 and into the well bore annulus. The check valve means 444 contains a ball and seat mechanism that is well known in the art and is commercially available from Energy Ventures Inc. under the mark Back Check.

Figure 11:
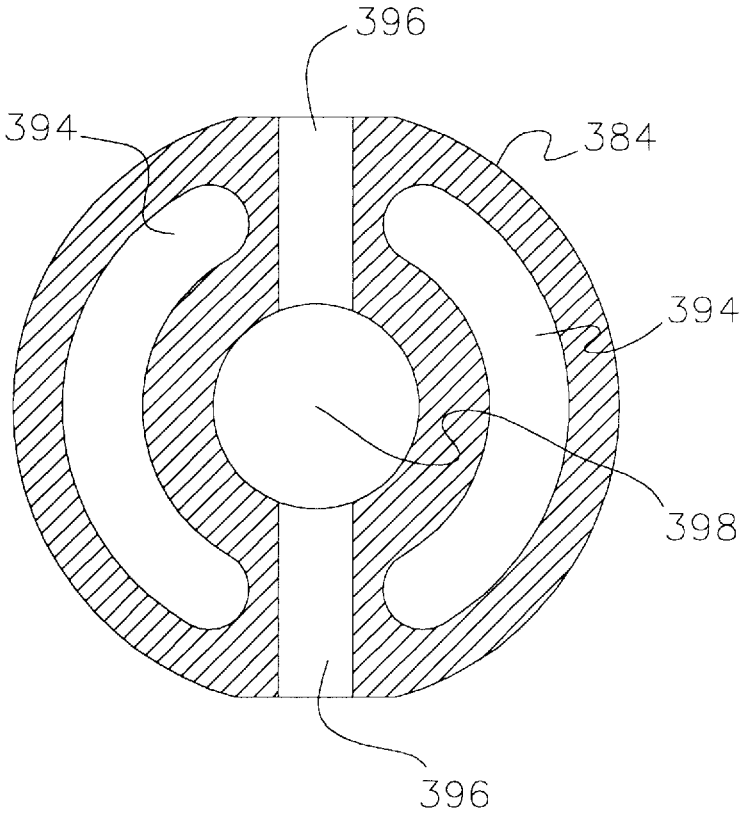
FIG. 11 is a cross-sectional view of the line A—A taken from FIGS. 7A–7B.
Figure 12:
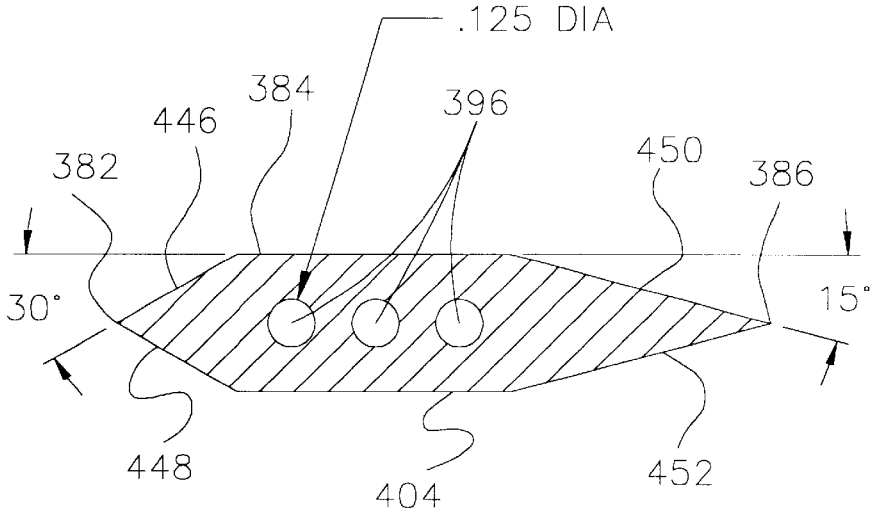
FIG. 12 is a cross-sectional view of the line B—B taken from FIGS. 7A–7B.

In FIG. 11, a cross-sectional view of the line A—A taken from FIG. 7B is shown. Thus, the inner mandrel 376 has disposed therein the first passageway 394 as well as the second passageway 396. Also shown is the cross-sectional area of the internal chamber 398. In FIG. 12, a cross-sectional view of the line B—B taken from FIGS. 7A–7B is illustrated. Thus, the second passageway 396 is shown along with the beveled shoulders 446, 448 of the upper portion, and beveled shoulders 450, 452 of the lower portion. The beveled shoulders facilitate efficient flow of the effluent into and out of the first passageway 394 and into the annulus 392. The preferred angles of the shoulders are shown in FIG. 12.

Figure 13:
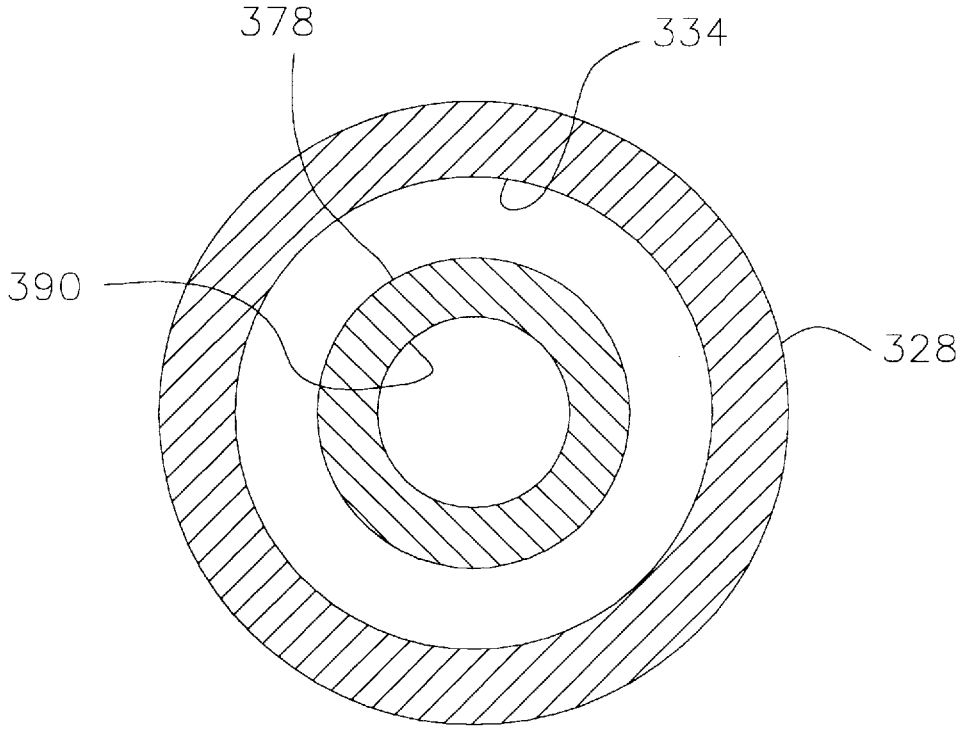
FIG. 13 is a cross-sectional view of the line C—C taken from FIGS. 7A–7B.

FIG. 13 is provided to show a cross-sectional view of the line C—C taken from FIG. 7B. Thus, the inner diameter surface 334 and outer conical surface 378 define the area wherein the effluent is directed. The inner bore 390 defines the area wherein the injection gas is directed therethrough.

In operation of the preferred embodiment seen in FIGS. 7A–7B and 8A–8B, the production accelerator device 300 is threadedly attached to the locking means 302 which in turn is attached to a running tool, with the running tool being commercially available from Specialty Machine & Supply Inc. under the mark SMSX Line Running Tool. The running tool is made-up to a work string, such as a wire line unit. It should be noted that the other types of work strings are available such as coiled tubing strings, electric line, snubbing pipe, etc. It should also be noted that the venturi device 300 herein disclosed may also be used in surfaces flow lines such as pipelines in order to accelerator flow.

Next, the tool string (including the production accelerator 300, locking means 302, and running tool) is lowered into the well bore to the desired depth of the sliding sleeve member 420, and in particular the nipple profile 442. The operator will go through the nipple profile 442, stop and thereafter pull-up hole through the nipple profile 442 which in turn causes the engagement of the locator dogs of the locking means. As is appreciated by those of ordinary skill in the art, the operator will again lower the tool string, and this time the locking keys 320 will locate into the nipple profile 442. The operator will jar downward which shears a pin on the running tool so that the locking means is now seated in the nipple profile 442 as seen in FIG. 9.

Thereafter, the operator can accelerate production with the venturi device 300. It should be noted that in the preferred embodiment the well bore intersects a hydrocarbon bearing reservoir, with the well bore containing a tubing string as well as the sliding sleeve member 420. The operator may inject a gas down the well bore annulus, with the gas being directed into the openings 434 which in turn will direct the injection gas into opening 348 of the tubular member.

Next, the well is flowed so that an effluent is produced, and the effluent is directed into the second channel 394 while the injection gas is directed into the first channel 396. As noted earlier in the application, the venturi effect of the injection gas exiting the inner bore 390 of the nozzle will create a zone of low pressure within the production accelerator device 300, and in particular within the annulus 392 generally at point "A" of FIG. 7B. This reduction of pressure causes an increase of the effluent from the reservoir since there is less pressure to buck, as was explained earlier in the application.

More particularly, the step of creating the zone of low pressure includes flowing the injection gas through the nozzle so that the gas exits into the throat section so that a zone of high pressure is created within the throat section. The venturi effect creates a pressure suction in the nozzle annulus at point "A". The suction fluid (reservoir fluid) becomes entrained with the high velocity jet and the pumping action then begins. After mixing in the throat, the combined power gas and suction fluid is slowed down within the diffuser. Because the velocity of this mixed stream (power gas and suction fluid) is reduced, the pressure increases within the diffuser—rising to a value sufficient to pump the fluid to the surface.

Changes and modifications in the specifically described embodiments can be carried out without departing from the scope of the invention which is intended to be limited only by the scope of the appended claims.

We claim:

1. An apparatus comprising:

an outer mandrel having an internal portion and an outer portion, and wherein said outer mandrel contains a first aperture therethrough, with the outer mandrel having a first end and a second end, and wherein said outer mandrel contains:

a throat section disposed within the internal portion of said outer mandrel; and, a diffuser section disposed within the internal portion of said outer mandrel, said diffuser section leading from said throat;

an inner mandrel disposed within said outer mandrel, said inner mandrel having a first end and a second end with said inner mandrel containing:

a nozzle located at the first end of said inner mandrel;

a first channelling member positioned to cooperate with said first aperture of said outer mandrel;

a second channelling member operatively associated with said second end of said inner mandrel.

2. The apparatus of claim 1 further comprising:

a diverter member attached at the second end of said inner mandrel so that a flow is directed into said second channelling member.

3. The apparatus of claim 2 further comprising:

valve means, operatively positioned within said inner mandrel, for allowing flow in a first direction and halting flow in a second direction.

4. The apparatus of claim 3 wherein said apparatus is positioned within a tubing string having an inner diameter and an outer diameter, the tubing string containing a selective means for selectively opening a second aperture, with the apparatus being disposed within said selective means so that the first aperture and second aperture are aligned to allow communication therethrough and wherein the apparatus further comprises:

seal means, operatively associated with the second end of said outer mandrel, for sealingly engaging with the tubing string inner diameter.

5. The apparatus of claim 4 wherein said diverter member is a conical member with a base portion and an apex portion, and wherein said base portion is positioned at the second end of said inner mandrel and said apex portion extends therefrom.

6. The apparatus of claim 5 wherein said tubing string has associated therewith a profile, and the apparatus further comprising:

lock means, operatively associated with the first end of said outer mandrel, for locking into said profile of said tubing string.

7. The apparatus of claim 3 wherein said apparatus is positioned within a tubing string having an inner diameter and an outer diameter, the tubing string containing a gas lift means for selectively opening a second aperture for introduction of a casing annulus gas into the internal diameter of the tubing string, with the apparatus being disposed within said gas lift means so that the first aperture and the second aperture are aligned to allow communication therethrough and wherein the apparatus further comprises:

seal means, operatively associated with the second end of said outer mandrel, for sealingly engaging with the inner diameter of said gas lift mandrel.

8. The apparatus of claim 7 wherein said diverter member is a conical member with a base portion and an apex portion, and wherein said base portion is positioned at the second end of said inner mandrel and said apex portion extends therefrom.

9. The apparatus of claim 8 wherein said outer mandrel has associated therewith wire line means for setting said apparatus within the inner diameter of said tubing string.

10. A device located within a tubing string for accelerating an oil and gas production from a reservoir, the device comprising:

a tubular member having an internal diameter and an outer diameter, said internal diameter containing:

a tapered section; and wherein said tubular member contains a first opening for allowing the injection of a gas therethrough;

an inner mandrel contained within said internal diameter of said tubular member, said inner mandrel containing:

a nozzle member having a first end and a second end, said nozzle member defining an internal chamber; a first passageway disposed within said second end of said nozzle; a second passageway disposed within said nozzle and operatively associated with said first opening of said tubular member so that said injection gas is communicated with said internal chamber.

11. The device of claim 10 wherein said nozzle member forms an annulus with the internal diameter of said tubular member, with said first end of said nozzle member being adjacent said tapered section, and wherein the injected gas is directed through said first opening and second passageway into said internal chamber.

12. The device of claim 11 further comprising:

a flow diverter means for diverting the production into said first passageway.

13. The device of claim 12 wherein said flow diverter means comprises:

a conical member attached at the second end of said inner mandrel with a base portion and an apex portion, and wherein said base portion is positioned at the second end of said inner mandrel and said apex portion extends therefrom.

14. The device of claim 13 further comprising:

valve means, operatively associated with said nozzle, for allowing flow in a first direction.

15. The device of claim 14 wherein said tubing string has an inner diameter and an outer diameter, the tubing string containing a selective means for selectively opening a second opening, with the tubular member being disposed within said sliding sleeve so that the first opening and the second opening are aligned to allow communication of the injected gas therethrough, and wherein the apparatus further comprises:

seal means, operatively associated with the second end of said tubular member, for sealingly engaging with the tubing string inner diameter.

16. The device of claim 15 wherein said selective means has associated therewith a profile member, and wherein said apparatus further comprises:

lock means, operatively associated with the first end of said tubular member, for locking into said profile member of said selective means.

17. The device of claim 14 wherein said device is positioned within a tubing string having an inner diameter and an outer diameter, the tubing string containing a gas lift means for selectively opening an aperture for introduction of a casing annulus gas into the internal diameter of the tubing string, with the device being disposed within said gas lift means so that the first opening and said aperture are aligned to allow communication of the casing annulus gas therethrough and wherein the device further comprises:

seal means, operatively associated with the second end of said tubular member, for sealingly engaging with the inner diameter of said gas lift mandrel.

18. The device of claim 17 wherein said second end of said tubular member has associated therewith wire line means for setting said apparatus within the inner diameter of said tubing string.

19. A method of accelerating production with a venturi device within a tubing string in a well bore, the tubing string having an internal diameter and an outer diameter, with the outer diameter of the tubing string and the well bore forming an annulus, the method comprising:

providing an aperture contained within the tubing string;

lowering into the tubing string the venturi device, with the venturi device comprising a tubular member having an internal diameter and an outer diameter, and an inner mandrel contained within said tubular member, and wherein:

(a) the tubular member contains: a tapered section, and an opening for allowing the injection of a gas therethrough; and, (b) the inner mandrel contains: a first channelling member, operatively associated with the opening of said tubular member; a nozzle member extending from said first channelling member and directed for discharging the injected gas into said throat section; and, a second channelling member for directing the production about said nozzle, the second channelling member creating a nozzle annulus;

placing the venturi device within the internal diameter of said tubing string;

injecting an injection gas into the annulus;

directing the injection gas through the aperture of the tubing string;

directing the injection gas through the opening contained within said tubular member.

20. The method of claim 19 further comprising:

flowing the well so that an effluent is produced;

directing the effluent into said second channelling member;

directing the injection gas into said first channelling member;

creating a zone of low pressure within the venturi device;

increasing an inflow of the effluent from the reservoir.

21. The method of claim 20 wherein said tapered section comprises a throat section and a diffuser section that extends from said throat section, and wherein the step of creating the zone of low pressure includes:

flowing the injection gas through said nozzle;

exiting the injection gas into said throat section so that a zone of high pressure is created within said throat section;

creating a pressure suction in said nozzle annulus.

22. The method of claim 21 further comprising the steps of:

mixing the effluent and the injection gas within said throat section;

producing the effluent and injection gas into the diffuser section.

23. The method of claim 22 wherein the aperture is provided as part of a sliding sleeve member contained on the tubing string, and wherein the step of providing the aperture includes:

lowering into the tubing string a shifting device;

shifting the sliding sleeve open so that the aperture allows communication from the well bore annulus into the internal diameter of the tubing string.

* * * * *